US008749148B2

(12) United States Patent
Lin

(10) Patent No.: US 8,749,148 B2
(45) Date of Patent: Jun. 10, 2014

(54) LIGHT EMITTING DIODE DRIVING INTEGRATED CIRCUIT AND METHOD FOR DRIVING A SERIES OF LIGHT EMITTING DIODES

(75) Inventor: Chung-Wei Lin, Hsin-Chu (TW)

(73) Assignee: Leadtrend Technology Corp., Science-Based Industrial Park, Hsin-Chu (TW)

( * ) Notice: Subject to any disclaimer, the term of this patent is extended or adjusted under 35 U.S.C. 154(b) by 154 days.

(21) Appl. No.: 13/350,796

(22) Filed: Jan. 15, 2012

(65) Prior Publication Data

US 2012/0112644 A1 May 10, 2012

Related U.S. Application Data

(63) Continuation-in-part of application No. 13/219,720, filed on Aug. 29, 2011.

(30) Foreign Application Priority Data

Sep. 13, 2010 (TW) ..... 99130924 A

(51) Int. Cl.
*H05B 37/00* (2006.01)

(52) U.S. Cl.
USPC ..... 315/185 R; 315/307

(58) Field of Classification Search
None
See application file for complete search history.

(56) References Cited

U.S. PATENT DOCUMENTS 7,919,936 B2 * 4/2011 Liu et al. ..... 315/307
2010/0013395 A1 * 1/2010 Archibald et al. ..... 315/185 R

* cited by examiner

*Primary Examiner* — Crystal L Hammond
(74) *Attorney, Agent, or Firm* — Winston Hsu; Scott Margo

(57) ABSTRACT

A driving integrated circuit of light emitting diodes is used for driving a plurality of series of light emitting diodes. The driving integrated circuit includes a current setting pin, a regulator circuit, and an adjuster. The driving integrated circuit sets a target current for a current flowing through the plurality of series of light emitting diodes according to an outflowing current of the current setting pin. The adjuster adjusts a target voltage according to the outflowing current. Then the regulator circuit provides a supply voltage for driving the plurality of series of light emitting diodes, so as to regulate a terminal voltage of the plurality of series of light emitting diodes to the target voltage.

12 Claims, 4 Drawing Sheets

LIGHT EMITTING DIODE DRIVING INTEGRATED CIRCUIT AND METHOD FOR DRIVING A SERIES OF LIGHT EMITTING DIODES

CROSS REFERENCE TO RELATED APPLICATIONS

This is a continuation-in-part application of U.S. application Ser. No. 13/219,720, filed on Aug. 29, 2011, which is included herein by reference.

BACKGROUND OF THE INVENTION

1. Field of the Invention

The present invention is related to a light emitting diode (LED) driving integrated circuit, and particularly to an LED driving integrated circuit that can dynamically change a terminal voltage of a series of light emitting diodes with a current flowing through the series of light emitting diodes.

2. Description of the Prior Art

In the prior art, after an LED driving integrated circuit utilizes a reference voltage generation circuit to generate a reference voltage, the LED driving integrated circuit can utilize the reference voltage to control a terminal voltage of a series of light emitting diodes through a closed loop formed by a boost converter. Thus, the terminal voltage of the series of light emitting diodes can be fixed to a target voltage, where the target voltage is used for providing a driving current for the series of light emitting diodes to operate normally.

However, after the target voltage is fixed, the target voltage can not be changed again. That is to say, the target voltage can not dynamically vary with an output current of the series of light emitting diodes adjusted by a user. Therefore, if the target voltage is too high, the LED driving integrated circuit may consume much energy and have lower energy efficiency; if the target voltage is too low, the driving integrated circuit may not operate normally.

SUMMARY OF THE INVENTION

An embodiment provides a light emitting diode (LED) driving integrated circuit for driving at least one light emitting diode. The LED driving integrated circuit includes a current setting pin, a regulator circuit, and an adjuster. A reference current flowing through the current setting pin is used for setting a target current for a current flowing through the at least one light emitting diode. The regulator circuit is used for regulating a terminal voltage of the at least one light emitting diode to a target voltage, and providing a supply voltage for driving the at least one light emitting diode. The adjuster is used for adjusting a target voltage according to the reference current.

Another embodiment provides an LED driving integrated circuit for driving a plurality of series of LEDs. The LED driving integrated circuit includes a current setting pin, a regulator circuit, and an adjuster. A reference current flowing through the current setting pin is used for setting a target current for a current flowing through the plurality of series of LEDs. The regulator circuit is used for regulating a lowest voltage of each of the plurality of series of the LEDs to a target voltage according to a reference voltage, and providing a supply voltage for driving the plurality of series of LEDs. The adjuster is used for generating the reference voltage according to the reference current.

Another embodiment provides an LED driving integrated circuit for driving a plurality of series of LEDs. The LED driving integrated circuit includes a driving current generator, a limiter, and a regulator circuit. The driving current generator is used for providing a current flowing through the plurality of series of LEDs. The limiter is coupled to a terminal of each of the plurality of series of LEDs for receiving and limiting a terminal voltage of each of the plurality of series of LEDs and outputting a limited voltage. The regulator circuit is used for regulating the terminal voltage to a target voltage according to a reference voltage, and providing a supply voltage for driving the plurality of series of LEDs.

Another embodiment provides method for driving a plurality of series of LEDs. The method includes providing a current flowing through each of the plurality of series of LEDs; receiving and limiting a terminal voltage of each of the plurality of series of LEDs and outputting a limited voltage; and regulating a terminal voltage of each of the plurality of series of LEDs to a target voltage according to a reference voltage, and providing a supply voltage for driving the plurality of series of LEDs.

The present invention provides an LED driving integrated circuit. The LED driving integrated circuit generates a reference current and sets a target current flowing through a series of light emitting diodes according to an external resistor. Then, a regulator circuit regulates a terminal voltage of the series of light emitting diodes to the target voltage according to the reference current. Thus, the target voltage can vary dynamically with the target current, increase energy efficiency of the LED driving integrated circuit, and reduce heat generated by the LED driving integrated circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
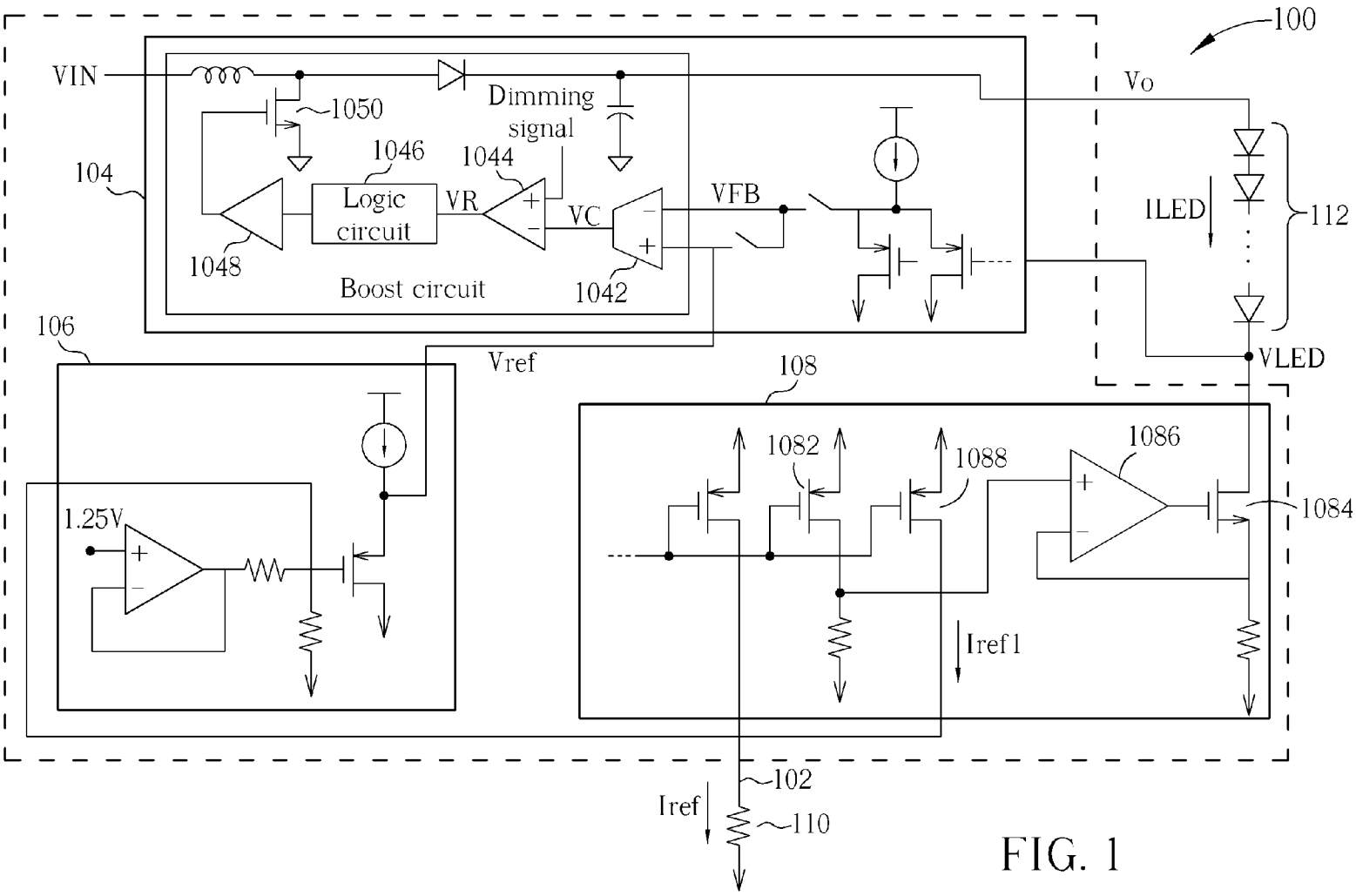
FIG. 1 is a diagram illustrating an LED driving integrated circuit according to an embodiment.

Please refer to FIG. 1. FIG. 1 is a diagram illustrating a light emitting diode (LED) driving integrated circuit 100 according to an embodiment. The LED driving integrated circuit 100 includes a current setting pin 102, a regulator circuit 104, and an adjuster 106. The current setting pin 102 is used for generating a reference current Iref through an external resistor 110. The driving integrated circuit 100 further includes a driving current generator 108 coupled to a series of light emitting diodes 112. The driving current generator 108 generates a target current ILED flowing through the series of light emitting diodes 112 according to the reference current Iref, transistors 1082, 1084, and an amplifier 1086. Then, the driving current generator 108 adds a first reference current Iref1 proportional to the reference current Iref to the adjuster 106 through a transistor 1088 included by the driving current generator 108. The adjuster 106 is coupled to the driving current generator 108 for generating a reference voltage Vref varying with the target current ILED according to the first reference current Iref1. The regulator circuit 104 is coupled to the adjuster 106. A compensator 1042 included by a boost circuit of the regulator circuit 104 is used for generating a compensation value VC according to the reference voltage Vref and a feedback voltage VFB. A comparator 1044 included by the boost circuit is used for generating a comparison result VR according to the compensation value VC and a dimming signal. The comparison result VR controls a switch 1050 through a logic circuit 1046 and a gate driving circuit 1048. Therefore, the regulator circuit 104 can regulate a terminal voltage of the series of light emitting diodes 112 to a target voltage VLED, and provide a supply voltage Vo for driving the series of light emitting diodes 112. Therefore, the target voltage VLED can vary dynamically with the target current ILED set by a user through the above mentioned loop.

Figure 2:
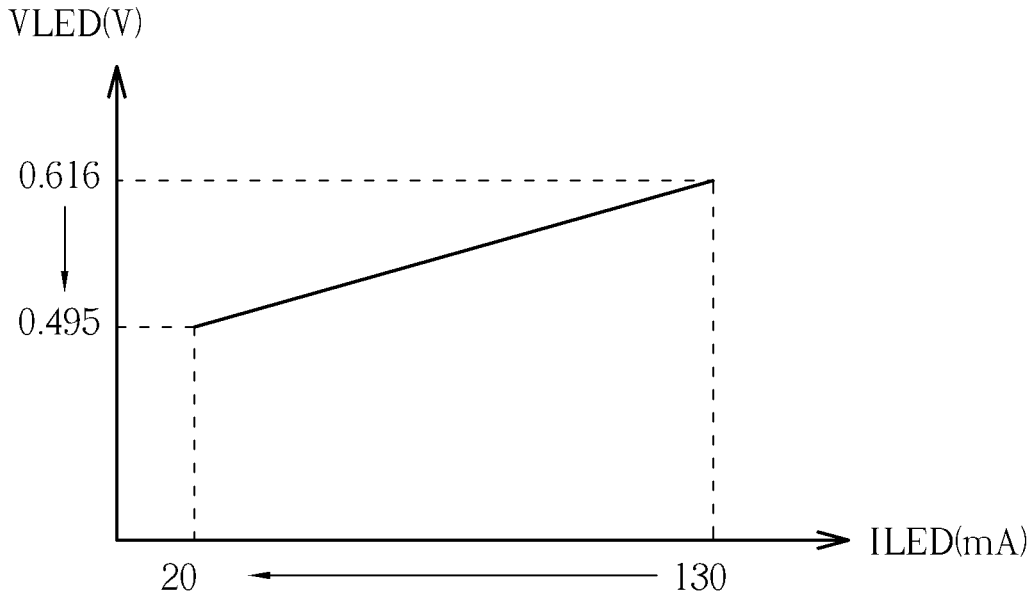
FIG. 2 is a diagram illustrating the target voltage dynamically varying with the target current.

Please refer to FIG. 2. FIG. 2 is a diagram illustrating the target voltage VLED varying dynamically with the target current ILED. As shown in FIG. 2, a positive relationship exists between the target voltage VLED and the target current ILED. Therefore, when the target voltage VLED changes from 0.495V to 0.616V, the target current ILED changes form 20 mA to 130 mA.

Figure 3:
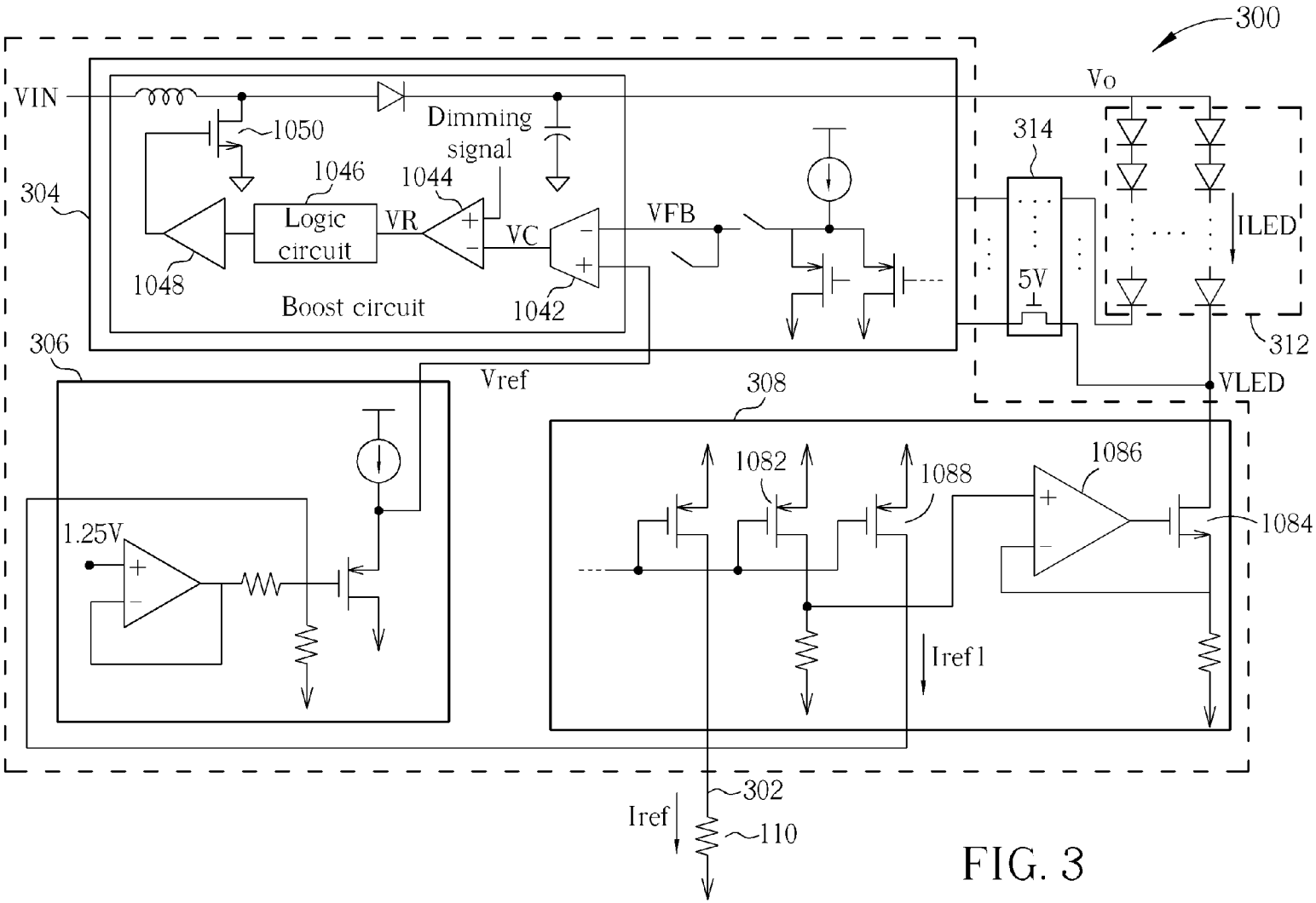
FIG. 3 is a diagram illustrating an LED driving integrated circuit according to another embodiment.

Please refer to FIG. 3. FIG. 3 is a diagram illustrating an LED driving integrated circuit 300 according to another embodiment. The LED driving integrated circuit 300 includes a current setting pin 302, a regulator circuit 304, an adjuster 306, and a limiter 314. The current setting pin 302 is the same as the current setting pin 102, and the adjuster 306 is the same as the adjuster 106, so further description thereof is omitted for simplicity. The driving integrated circuit 300 further includes a driving current generator 308 coupled to a plurality of series of LEDs 312. The driving current generator 308 is the same as the driving current generator 108, so further description thereof is omitted for simplicity. A difference between the LED driving integrated circuit 300 and the LED driving integrated circuit 100 is that the regulator circuit 304 is coupled to the adjuster 306 for regulating a lowest voltage of each of the plurality of series of the LEDs 312 to a target voltage VLED, and providing a supply voltage Vo for driving the plurality of series of LEDs 112, where the lowest voltage of each of the plurality of series of the LEDs 312 is limited by the limiter 314 before being received by the regulator circuit 304. As shown in FIG. 3, the limiter 114 has a plurality of high voltage metal-oxide-semiconductor transistors, where each of the plurality of high voltage metal-oxide-semiconductor transistors has a first terminal coupled to a corresponding series of LEDs of the plurality of series of the LEDs 312, a second terminal for receiving a predetermined voltage (such as 5V), and a third terminal coupled to the regulator circuit 304. Therefore, the high voltage metal-oxide-semiconductor transistor is turned on only when a voltage of the third terminal of the high voltage metal-oxide-semiconductor transistor is less than the predetermined voltage minus a threshold voltage of the high voltage metal-oxide-semiconductor transistor. Therefore, the lowest voltage of each of the plurality of series of LEDs 312 is limited by the limiter 314 before being received by the regulator circuit 304 (that is, the voltage of the third terminal of the high voltage metal-oxide-semiconductor transistor is limited) to prevent the regulator circuit 304 from being damaged. That is to say, when any of the plurality of series of the LEDs 312 is short, the regulator circuit 304 can still operate normally because a corresponding high voltage metal-oxide-semiconductor transistor is turned off. Further, subsequent operational principles of the LED driving integrated circuit 300 are the same as those of the LED driving integrated circuit 100, so further description thereof is omitted for simplicity.

Figure 4:
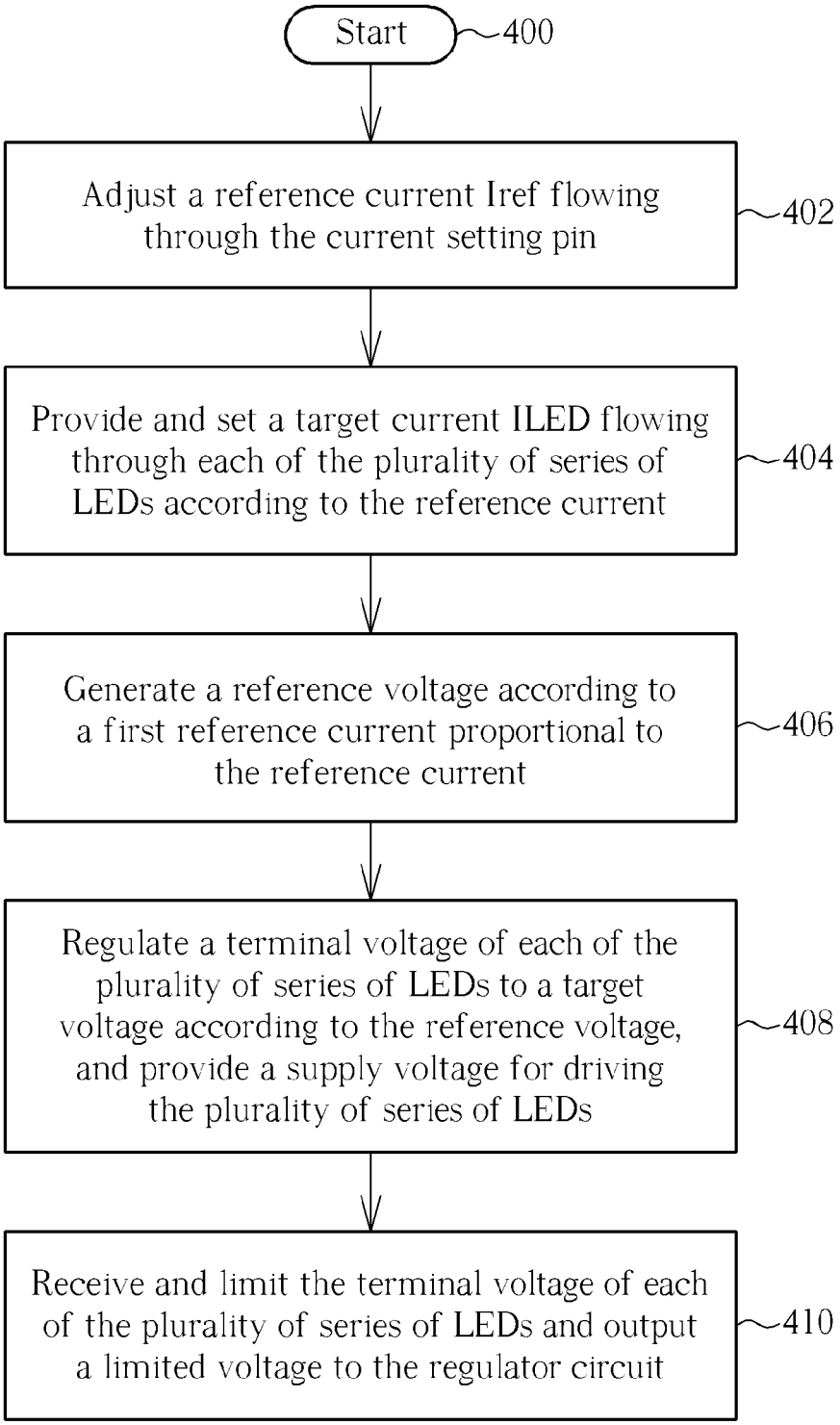
FIG. 4 is a flowchart illustrating a method for driving a plurality of series of LEDs according to another embodiment.

Please refer to FIG. 4. FIG. 4 is a flowchart illustrating a method for driving a plurality of series of LEDs 312 according to another embodiment. The method in FIG. 4 is illustrated using the LED driving integrated circuit 300 in FIG. 3. Detailed steps are as follows:

Step 400: Start.

Step 402: Provide a reference current Iref flowing through the current setting pin 110.

Step 404: Provide and set a target current ILED flowing through each of the plurality of series of LEDs 312 according to the reference current Iref.

Step 406: Generate a reference voltage Vref according to a first reference current Iref1 proportional to the reference current Iref.

Step 408: Regulate a terminal voltage of each of the plurality of series of LEDs 312 to a target voltage VLED according to the reference voltage Vref, and provide a supply voltage Vo for driving the plurality of series of LEDs 312.

Step 410: Receive and limit the terminal voltage of each of the plurality of series of LEDs 312 and output a limited voltage to the regulator circuit 304.

In Step 410, as shown in FIG. 3, because each high voltage metal-oxide-semiconductor transistor included by the limiter 314 is turned on only when a voltage of a third terminal of each high voltage metal-oxide-semiconductor transistor included by the limiter 314 is less than a predetermined voltage minus a threshold voltage of each high voltage metal-oxide-semiconductor transistor included by the limiter 314, the lowest voltage of each of the plurality of series of the LEDs 312 is limited by the limiter 314 before being received by the regulator circuit 304 to prevent the regulator circuit 304 from being damaged. That is to say, when any of the plurality of series of the LEDs 312 is short, the regulator circuit 304 can still operate normally because a corresponding high voltage metal-oxide-semiconductor transistor is turned off. Thus, the limiter 314 can output the limited voltage to the regulator circuit 304 to prevent the regulator circuit 304 from being damaged.

To sum up, the LED driving integrated circuit generates the reference current and sets the target current flowing through the series of light emitting diodes according to the external resistor, and utilize the limiter to limit the terminal voltage of each of the plurality of series of LEDs before being received by the regulator circuit to prevent the regulator circuit from being damaged. Then, the regulator circuit regulates the terminal voltage of the series of light emitting diodes to the target voltage according to the reference current. Thus, the target voltage can vary dynamically with the target current to improve on the fixed target voltage in the prior art, increase energy efficiency of the LED driving integrated circuit, and reduce heat generated by the LED driving integrated circuit. In addition, the present invention can also prevent the regulator circuit from being damaged.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitting diode (LED) driving integrated circuit for driving a plurality of series of LEDs comprising at least one LED, the LED driving integrated circuit comprising:

a current setting pin, wherein a reference current flowing through the current setting pin is used for setting a target current for a current flowing through the plurality of series of LEDs;

a regulator circuit for regulating a lowest voltage of each of the plurality of series of the LEDs to a target voltage according to a reference voltage, and providing a supply voltage for driving the plurality of series of LEDs, wherein the lowest voltage of each of the plurality of series of the LEDs is limited by a limiter before being received by the regulator circuit; and an adjuster for generating the reference voltage according to the reference current.

2. The LED driving integrated circuit of claim 1, wherein the current setting pin is coupled to an external resistor, and the external resistor is used for adjusting the reference current.

3. The LED driving integrated circuit of claim 1, further comprising:

a driving current generator for generating the target current according to the reference current.

4. The LED driving integrated circuit of claim 1, wherein the adjuster generates the reference voltage according to a first reference current proportional to the reference current.

5. The LED driving integrated circuit of claim 1, wherein the regulator circuit generates the target voltage according to the reference voltage.

6. A light emitting diode (LED) driving integrated circuit for driving a plurality of series of LEDs comprising at least one LED, the LED driving integrated circuit comprising:

a driving current generator for providing a current flowing through the plurality of series of LEDs;

a limiter coupled to a terminal of each of the plurality of series of LEDs for receiving and limiting a lowest voltage of each of the plurality of series of LEDs and outputting a limited voltage; and a regulator circuit for regulating the lowest voltage to a target voltage according to a reference voltage, and providing a supply voltage for driving the plurality of series of LEDs, wherein the lowest voltage of each of the plurality of series of the LEDs is limited by the limiter before being received by the regulator circuit.

7. The LED driving integrated circuit of claim 6, wherein the limiter is a high voltage metal-oxide-semiconductor transistor.

8. The LED driving integrated circuit of claim 7, further comprising:

a current setting pin coupled to an external resistor, wherein the external resistor is used for adjusting a reference current flowing through the current setting pin, and the reference current is used for setting a target current for the current flowing through the plurality of LED series.

9. The LED driving integrated circuit of claim 8, further comprising:

an adjuster for generating the reference voltage according to a first reference current proportional to the reference current.

10. A method for driving a plurality of series of light emitting diodes (LEDs) comprising at least one LED, the method comprising:

providing a current flowing through each of the plurality of series of LEDs;

receiving and limiting a lowest voltage of each of the plurality of series of LEDs and outputting a limited voltage; and regulating a the lowest voltage of each of the plurality of series of LEDs to a target voltage according to a reference voltage, and providing a supply voltage for driving the plurality of series of LEDs, wherein the lowest voltage of each of the plurality of series of the LEDs is limited by the limiter before being received by the regulator circuit.

11. The method of claim 10, further comprising:

providing a reference current flowing through a current setting pin; and setting a target current for the current flowing through the plurality of series of LEDs.

12. The method of claim 11, further comprising:

generating the reference voltage according to a first reference current proportional to the reference current.

* * * * *